US007296310B2

(12) United States Patent
Kozlowski et al.

(10) Patent No.: US 7,296,310 B2
(45) Date of Patent: Nov. 20, 2007

(54) ADJUSTABLE MATTRESS FOUNDATION

(75) Inventors: Derek Scott Kozlowski, Chesnee, SC (US); Mark Alan Hornung, Campobello, SC (US); Jonathan Paul Kane, Lynn, SC (US)

(73) Assignee: Milliken & Company, Spartanburg, SC (US)

( * ) Notice: Subject to any disclaimer, the term of this patent is extended or adjusted under 35 U.S.C. 154(b) by 94 days.

(21) Appl. No.: 11/208,993

(22) Filed: Aug. 22, 2005

(65) Prior Publication Data

US 2007/0039099 A1 Feb. 22, 2007

(51) Int. Cl.
*A47C 19/00* (2006.01)
*A47C 31/00* (2006.01)
*A47C 23/06* (2006.01)

(52) U.S. Cl. ..... 5/400; 5/11; 5/236.1

(58) Field of Classification Search ..... 5/11, 5/201, 249–252, 400, 935, 200.1, 282.1, 5/509.1; 248/188.2
See application file for complete search history.

(56) References Cited

U.S. PATENT DOCUMENTS

| | | | | |
|---|---|---|---|---|
| 35,763 | A | 7/1862 | Knowles | |
| 101,327 | A | 3/1870 | Springer | |
| 135,885 | A | 2/1873 | Bush | |
| 352,480 | A | 11/1886 | Meeks | |
| 586,645 | A | 7/1897 | Wichmann | |
| 927,982 | A | 7/1909 | Klipfel | |
| 1,247,429 | A | 11/1917 | Lipps | |
| 1,370,036 | A | 3/1921 | Molis | |
| 1,741,038 | A | 12/1929 | Rubin | |
| 1,875,435 | A | 9/1932 | Franzen | |
| 2,154,910 | A | 4/1939 | Magaril | |
| 2,226,172 | A | 12/1940 | Massacese | |
| 2,985,895 | A | 5/1961 | Bloom | |
| 3,795,018 | A | 3/1974 | Broaded | |
| 4,100,631 | A | 7/1978 | Slone | |
| 4,163,296 | A | 8/1979 | Kitchen et al. | |
| 4,181,991 | A | 1/1980 | Morgan et al. | |
| 4,620,336 | A | 11/1986 | Miller | |
| 4,771,995 | A | 9/1988 | Wells et al. | |
| 5,127,114 | A | 7/1992 | Horburger | |
| 5,144,706 | A | 9/1992 | Walker | |
| 5,210,890 | A | 5/1993 | Hagglund | |
| 5,271,112 | A * | 12/1993 | Bible et al. | 5/493 |
| 5,471,688 | A | 12/1995 | Cavazos | |
| 5,495,629 | A | 3/1996 | Hüsler | |
| 5,513,402 | A | 5/1996 | Schwartz | |
| 5,758,372 | A | 6/1998 | Lopez Diaz | |

(Continued)

FOREIGN PATENT DOCUMENTS

| | | |
|---|---|---|
| CH | 670 944 A5 | 7/1989 |

(Continued)

*Primary Examiner*—Patricia Engle
*Assistant Examiner*—Jonathan Liu
(74) *Attorney, Agent, or Firm*—Terry T. Moyer; Cheryl J. Brickey

(57) ABSTRACT

An adjustable mattress foundation comprises a lower frame, an upper frame, and a plurality of movable supports attached to the lower frame or the upper frame. The movable supports are adapted to maintain the upper and lower frames in spaced apart relation and are further adapted to permit vertical movement of the upper frame into a plurality of spaced apart relations relative to the lower frame.

1 Claim, 7 Drawing Sheets

U.S. PATENT DOCUMENTS

| | | | | |
|---|---|---|---|---|
| 5,765,240 | A | 6/1998 | Workman | |
| 5,878,451 | A | 3/1999 | Lumine | |
| 6,161,234 | A | 12/2000 | Amann | |
| 2003/0088914 | A1 | 5/2003 | Vigneron | |
| 2003/0222741 | A1 | 12/2003 | Martin | |
| 2005/0120478 | A1* | 6/2005 | Hofmann | 5/400 |

FOREIGN PATENT DOCUMENTS

| | | | |
|---|---|---|---|
| DE | 3640532 | A1 | 6/1988 |
| DE | 38 00 781 | A1 | 7/1988 |
| DE | 37 16 917 | A1 | 12/1988 |
| DE | 19643085 | A1 | 4/1998 |
| GB | 2063664 | A | 6/1981 |
| GB | 2323274 | A | 9/1998 |
| WO | WO 94/07394 | A1 | 4/1994 |
| WO | WO 2005/046397 | A2 | 5/2005 |

* cited by examiner

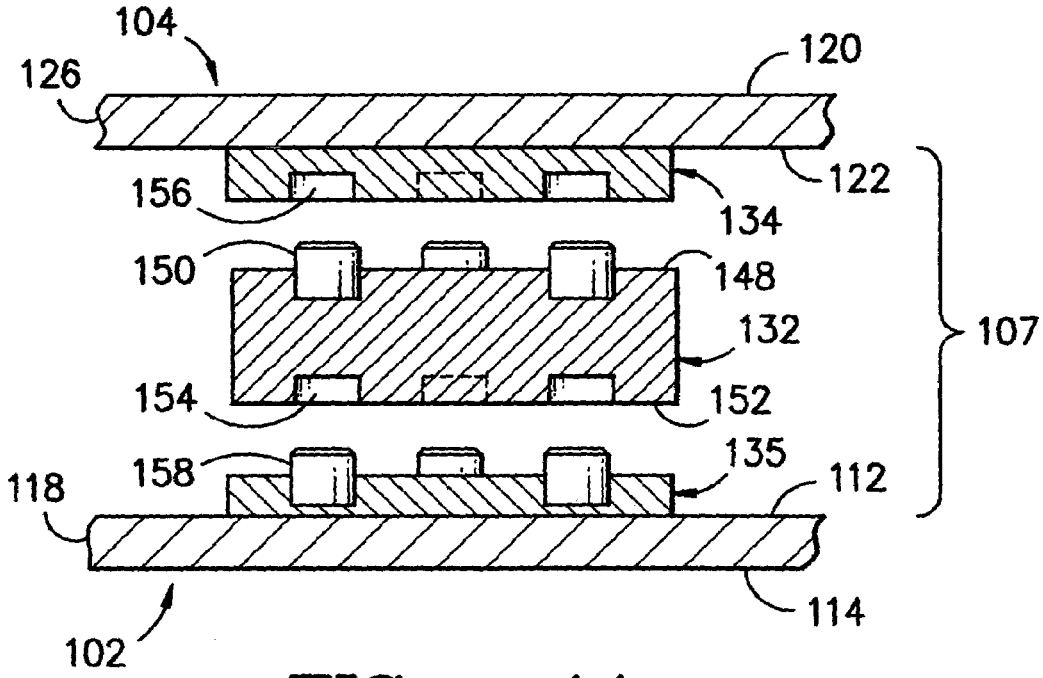
FIG. —4A—
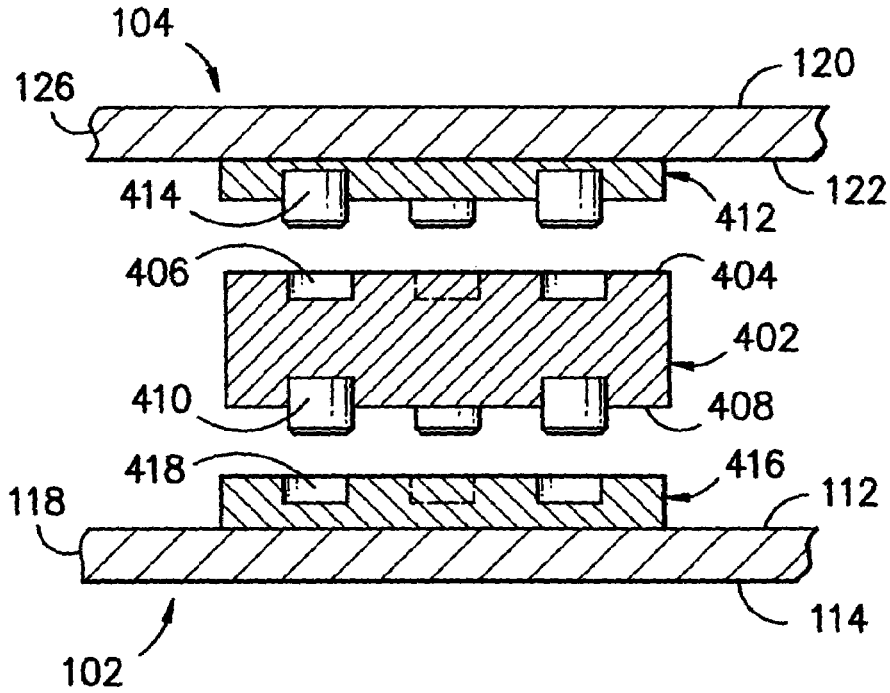
FIG. —4B—

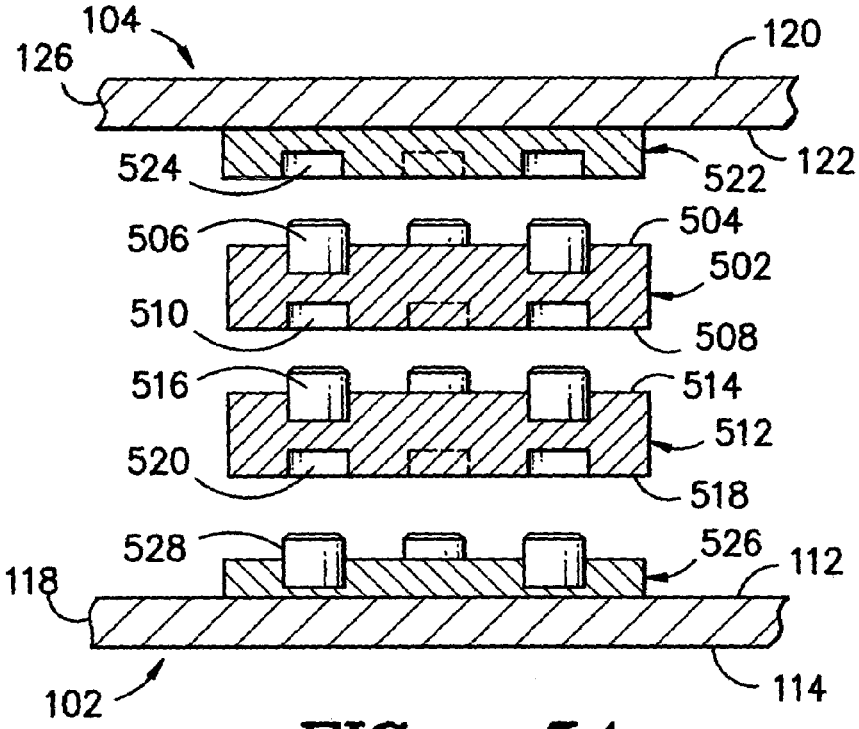
FIG. –5A–
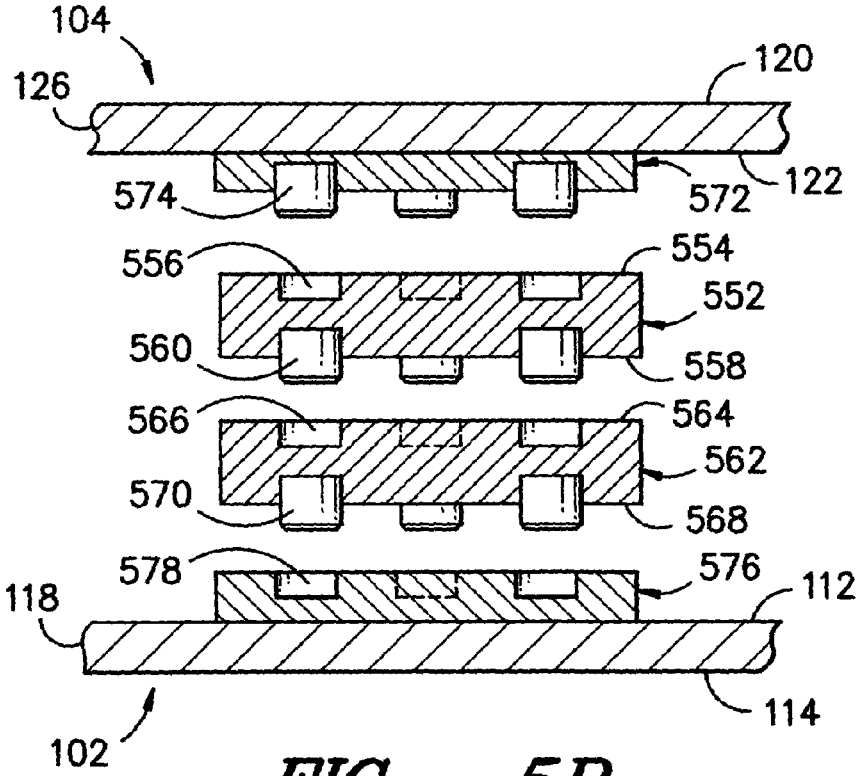
FIG. –5B–

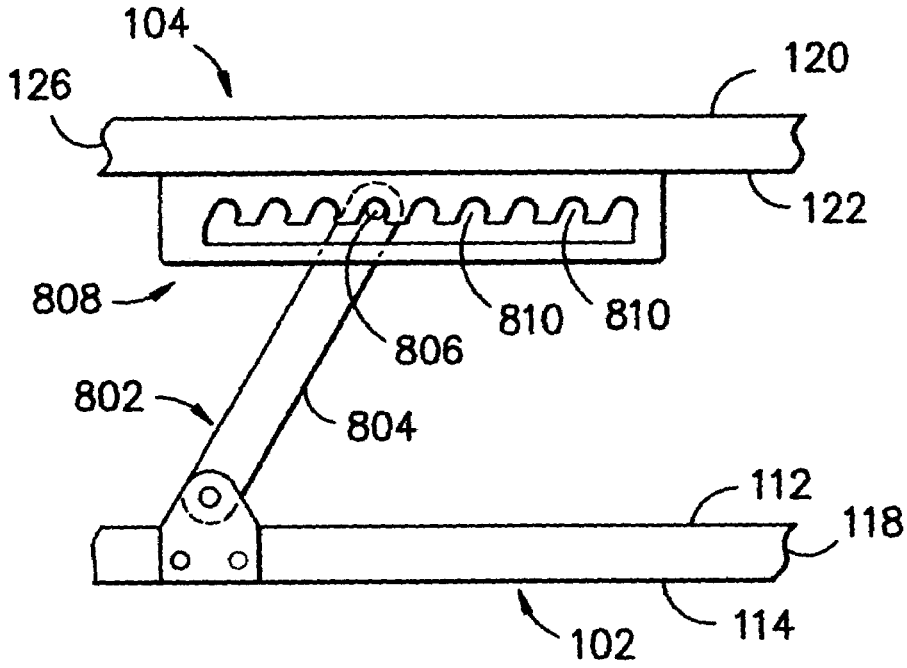
FIG. –8–
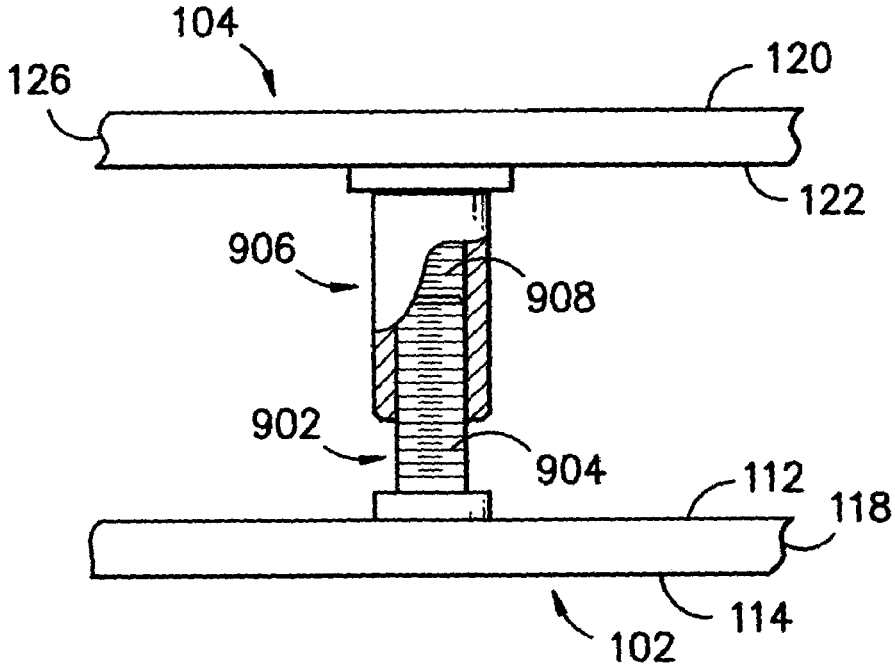
FIG. –9–

ADJUSTABLE MATTRESS FOUNDATION

FIELD OF THE INVENTION

This invention pertains to a foundation for a mattress in which the height of the foundation can be adjusted.

BACKGROUND OF THE INVENTION

A mattress foundation is an integral part of most beds. The foundation serves to distribute loads applied to the mattress which, in turn, can make the mattress feel more comfortable and prolong its life relative to a mattress that is not supported by a foundation. While the mattress foundation serves these important purposes, existing foundations suffer from several limitations inherent to their design.

For example, assembled foundations often occupy a rather large volume, much of which is empty space unoccupied by the springs or frame members that provide structure to the foundation. Thus, when the assembled foundations are shipped to distributors or customers, much of the "freight" that is hauled from the manufacturer is actually just air. This waste decreases the number of assembled foundations that can be shipped using a finite capacity and, accordingly, the cost associated with this finite shipping capacity is spread among fewer foundations.

Also, typical mattress foundations are made from fixed frames whose dimensions cannot be adjusted. Therefore, the height of the foundation, which will impact the overall height of the bed (i.e., stacked mattress and foundation), cannot be adjusted. However, customers may wish, for various aesthetic and functional considerations, to have the ability to select from a number of different bed heights. In order to provide this option using typical mattress foundations, the manufacturer must produce and the distributor or retailer must stock several different foundations, each having a different height, for a given bed. The increased/custom manufacturing capacity and increased inventory necessary to provide this option to consumers would further increase the cost of each foundation.

A need therefore exits for a mattress foundation that can be provided at different heights, thereby permitting the overall height of a bed utilizing the foundation to be varied. A need also remains for a mattress foundation whose overall volume can be reduced during shipping, thereby permitting more foundations to be shipped using a finite capacity. The invention provides such a mattress foundation. These and other advantages of the invention, as well as additional inventive features, will be apparent from the description of the invention provided herein.

BRIEF SUMMARY OF THE INVENTION

The invention provides a foundation for a mattress. The foundation comprises (a) a lower frame having a top, a bottom, a perimeter, and one or more lower frame members disposed around at least a portion of the perimeter of the lower frame, (b) an upper frame having a top, a bottom, a perimeter, and one or more upper frame members disposed around at least a portion of the perimeter of the upper frame, and (c) a plurality of movable supports attached to one or more of the lower frame member and the upper frame member. The movable supports are adapted to maintain the upper frame and the lower frame in spaced apart relation and to permit vertical movement of the upper frame into a plurality of spaced apart relations relative to the lower frame.

The upper and lower frames can have any suitable configuration. For example, the upper and lower frames can be substantially rectangular in shape. In such an embodiment, the foundation preferably comprises at least four movable supports, one of which is disposed in each corner of the upper frame or the lower frame.

In certain embodiments, the movable supports comprise a support member and a receiving member. The receiving member is attached to the lower frame member and/or the upper frame member and is adapted to receive the support member and restrict lateral movement of the support member relative to the upper frame and the lower frame. The support member can have any suitable configuration. However, in a preferred embodiment, the support member is substantially rectangular in shape and has a length, a width, and a height, all of which are unequal.

In another embodiment, the support member comprises a top surface, a bottom surface, a recess in the bottom surface, and a key disposed on the top surface thereof. The receiving member comprises an upper receiving member attached to the upper frame member and a lower receiving member attached to the lower frame member, the upper receiving member comprising a recess adapted to receive the key disposed on the top surface of the support member, and the lower receiving member comprises a second key adapted to communicate with the recess in the bottom surface of the support member. Alternatively, the recess can be disposed on the top surface of the support member and the key can be disposed on the bottom surface of the support member. In such an embodiment, the lower receiving member comprises a recess disposed on the bottom surface of the support member, and the upper receiving member comprises a key adapted to communicate with the recess in the top surface of the support member.

In another embodiment, each movable support can comprise a plurality of support members, an upper receiving member attached to the upper frame member, and a lower receiving member attached to the lower frame member. Each support member comprises a top surface, a bottom surface, a recess in the bottom surface thereof, and a key disposed on the top surface thereof. The upper receiving member comprises a recess adapted to receive the key disposed on the top surface of one of the support members, and the lower receiving member comprises a second key adapted to communicate with the recess in the bottom surface of one of the support members. Alternatively, each support member can comprise a recess in the top surface thereof, and a key disposed on the bottom surface thereof. In such an embodiment, the lower receiving member comprises a recess adapted to receive the key disposed on the bottom surface of one of the support members, and the upper receiving member comprises a second key adapted to communicate with the recess in the top surface of one of the support members.

In another embodiment, the support member can comprise a substantially circular post having a circumference and a helical thread disposed around the circumference of the post. In such an embodiment, the receiving member comprises a sleeve adapted to receive the post, the sleeve comprising a helical thread disposed around the circumference of its inner surface. In this embodiment, one of the sleeve or post is rotatably mounted to the upper frame member or the lower frame member. Thus, as the post or sleeve is rotated, the vertical distance between the upper and lower frames can be adjusted.

In another embodiment, the movable supports comprise a post, a sleeve adapted to receive the post, and a pin. The post has at least one hole through the distal end thereof, and the sleeve has a plurality of aligned holes disposed along its length. The pin is adapted to pass through at least one of the holes in the sleeve and the hole in the post.

In another embodiment, the movable supports comprise a support member comprising an arm and a receiving member adapted to receive a pin attached to the distal end of the arm. In particular, the support member comprises an arm having a pin attached to its distal end and is pivotally attached to the upper frame member or the lower frame member at its proximal end. The receiving member comprises a plurality of recesses disposed along its length, and the recesses are adapted to receive the pin attached to the arm of the support member. Thus, as the arm is pivoted with respect to the frame member, the pin on the distal end of the arm can be set into a different recess on the receiving member.

In certain embodiments, the foundation can comprise a cover that masks the frames and movable supports from view. In particular, the cover has a top portion and a side portion, the top portion of the cover rests on the top of the upper frame, and the side portion of the cover extends around at least a portion of the perimeter of the upper frame. The cover can further comprise a bottom portion having a perimeter and a resilient material attached to a least a portion of the perimeter of the bottom portion of the cover. In such an embodiment, the side portion of the cover extends around at least a portion of the perimeter of the lower frame, and the bottom portion of the cover contacts the bottom of the lower frame.

BRIEF DESCRIPTION OF THE DRAWINGS

FIG. 4A is an exploded, sectional view along line 4A of a movable support depicted in FIG. 1.

FIG. 4B is an exploded, sectional view of a movable support suitable for use in the foundation of the invention.

FIG. 5A is an exploded, sectional view of a movable support suitable for use in the foundation of the invention.

FIG. 5B is an exploded, sectional view of a movable support suitable for use in the foundation of the invention.

FIG. 8 is an elevation view of a movable support suitable for use in the foundation of the invention.

FIG. 9 is an elevation, partial cut-away view of a movable support suitable for use in the foundation of the invention.

DETAILED DESCRIPTION OF THE INVENTION

As noted above, the invention provides a foundation for a mattress. The foundation is adapted to permit adjustment of its overall height, thereby permitting the distance between the upper surface of a mattress resting on the foundation and the surface on which the foundation rests (e.g., a floor or a bed frame) to be adjusted.

Figure 1:
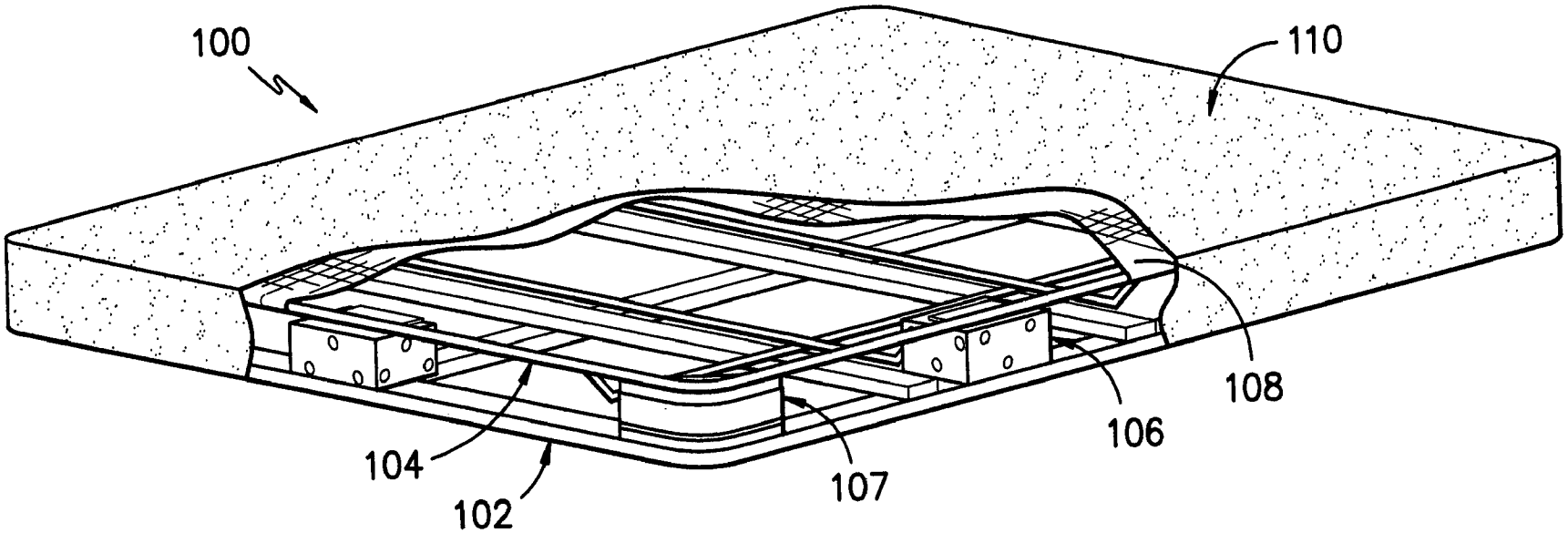
FIG. 1 is a perspective, partial cut-away view of a foundation according to the present invention.
Figure 2:
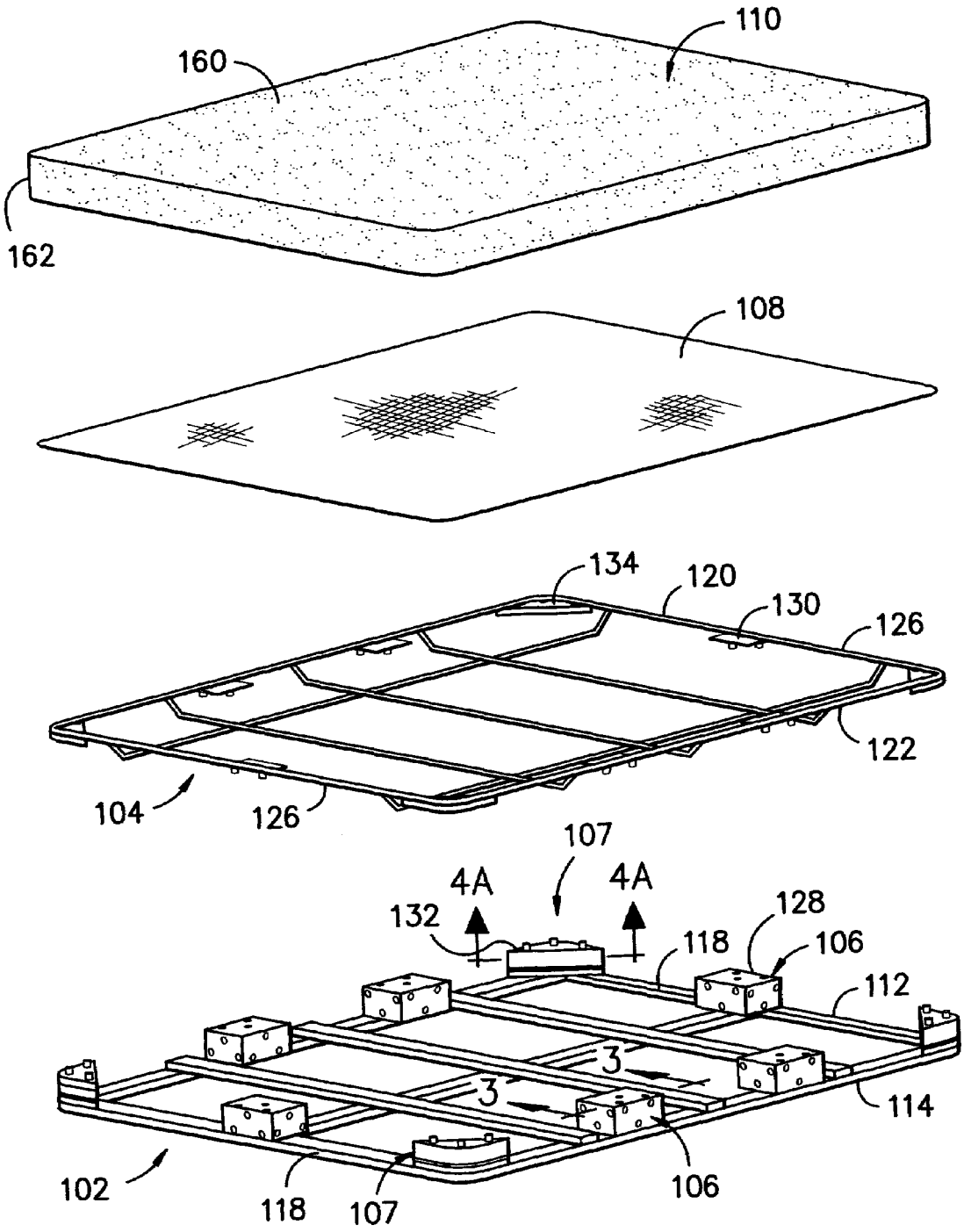
FIG. 2 is an exploded, perspective view of the foundation depicted in FIG. 1.

Turning now to FIG. 1, the foundation 100 comprises a lower frame 102, an upper frame 104, and a plurality of movable supports 106, 107 attached to the lower frame 102 or the upper frame 104. As shown in FIG. 2, the lower frame 102 has a top 112, a bottom 114, a perimeter, and one or more lower frame members 118 disposed around at least a portion of the perimeter of the lower frame 102. The upper frame 104 also has a top 120, a bottom 122, a perimeter, and one or more upper frame members 126 disposed around at least a portion of the perimeter of the upper frame 104. As depicted in FIG. 2, the movable supports 106, 107 are attached to the lower frame member 118; however, the movable supports can be attached to the upper frame member or both the upper frame member and the lower frame member. As will be understood by those of ordinary skill in the art, the means of attaching the movable supports to the frame member(s) should not interfere with the movement of the movable supports necessary to permit vertical movement of the upper frame relative to the lower frame.

The upper and lower frames can have any suitable configuration. For example, as depicted in FIGS. 1 and 2, the upper frame 104 and the lower frame 102 can be substantially rectangular in shape. In such an embodiment, the foundation 100 preferably comprises at least four movable supports 107, with one of the four movable supports 107 disposed in each corner of the upper frame 104 or the lower frame 102. The upper and lower frames can be made from any suitable material(s). For example, the upper and lower frames can be made from wood (e.g., pine, maple, oak, etc.) or from metal (e.g., steel, aluminum, etc.).

As shown in FIG. 2, the movable supports 106, 107 can comprise a support member 128, 132 and at least one receiving member 130, 134. The receiving member 130, 134 is attached to one of the lower frame member 118 and the upper frame member 126 and is adapted to receive the support member 128, 132 and restrict lateral movement of the support member 128, 132 relative to the upper frame 104 and the lower frame 102. The support member can have any suitable configuration. For example, support member can be substantially rectangular in shape. Such an embodiment is shown in FIG. 2, where the support member 128 is substantially rectangular in shape and has a length, a width, and a height, all of which are unequal. In such an embodiment, the height of the upper frame 104 relative to the lower frame 102 can be adjusted between one of three predetermined heights based on the orientation of the support member 128 within the foundation 100. Alternatively, the support member can have a substantially triangular cross section when viewed from the top of the support member (i.e., from a direction that is parallel to the height of the support member). Such an embodiment is also shown in FIG. 2, where the support member 132 has a substantially triangular cross section. A support member having this configuration is particularly well suited for placement in the corners of substantially rectangular upper and lower frames.

Figure 3:
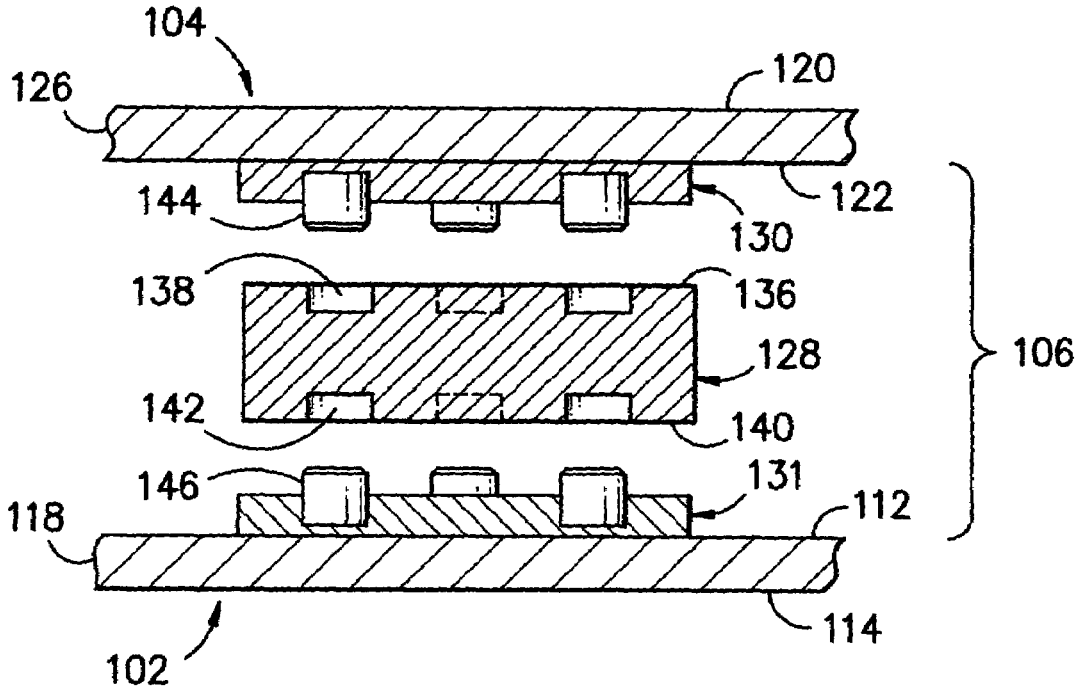
FIG. 3 is an exploded, sectional view along line 3 of a movable support depicted in FIG. 1.

FIG. 3 shows an exploded, cross sectional view along line 3 of the movable support 106 shown in FIGS. 1 and 2. As shown, the movable support 106 comprises a support member 128, an upper receiving member 130, and a lower receiving member 131. The support member 128 has a top surface 136, at least one recess 138 disposed in the top surface 136 thereof, a bottom surface 140, and at least one recess 142 disposed in the bottom surface 140 thereof. The upper receiving member 130 is fixedly attached to the upper frame member 126 at the bottom 122 of the upper frame 104. The upper receiving member 130 comprises at least one key 144 that communicates with the recess 138 disposed in the top surface 136 of the support member 128. The lower receiving member 131 is fixedly attached to the lower frame member 118 at the top 112 of the lower frame 102. The lower receiving member 131 also comprises at least one key 146 that communicates with the recess 142 disposed in the bottom surface 140 of the support member 128. In order to further stabilize the support member from lateral or rotational movement relative to the upper frame member and the lower frame member, the support member preferably comprises multiple recesses and the upper and lower receiving members comprise multiple keys that communicate with the recesses in the surfaces of the support member.

FIG. 4A shows an exploded, cross sectional view along line 4A of the movable support 107 shown in FIGS. 1 and 2. As shown, the movable support 107 comprises a support member 132, an upper receiving member 134, and a lower receiving member 135. The support member 132 has a top surface 148, at least one key 150 disposed on the top surface 148 thereof, a bottom surface 152, and at least one recess 154 disposed in the bottom surface 152 thereof. The upper receiving member 134 is fixedly attached to the upper frame member 126 at the bottom 122 of the upper frame 104. The upper receiving member 134 comprises at least one recess 156 that communicates with the key 150 disposed on the top surface 144 of the support member 132. The lower receiving member 135 is fixedly attached to the lower frame member 118 at the top 112 of the lower frame 102. The lower receiving member 135 comprises at least one key 158 that communicates with the recess 154 disposed in the bottom surface 152 of the support member 132. In order to further stabilize the support member from lateral or rotational movement relative to the upper frame member and the lower frame member, the support member preferably comprises multiple keys disposed on its top surface and multiple recesses disposed on its bottom surface, the upper receiving member comprises multiple recesses that communicate with the keys on the top surface of the support member, and the lower receiving member comprises multiple keys that communicate with the recesses in the bottom surface of the support member.

FIG. 4B shows an alternative embodiment of the movable support depicted in FIG. 4A. As shown, the movable support comprises a support member 402, an upper receiving member 412, and a lower receiving member 416. The support member 402 has a top surface 404, at least one recess 406 disposed in the top surface 404 thereof, a bottom surface 408, and at least one key 410 disposed on the bottom surface 408 thereof. The upper receiving member 412 is fixedly attached to the upper frame member 126 at the bottom 122 of the upper frame 104. The upper receiving member 412 comprises at least one key 414 that communicates with the recess 406 disposed in the top surface 404 of the support member 402. The lower receiving member 416 is fixedly attached to the lower frame member 118 at the top 112 of the lower frame 102. The lower receiving member 416 comprises at least one recess 418 that communicates with the key 410 disposed on the bottom surface 408 of the support member 402. In order to further stabilize the support member from lateral or rotational movement relative to the upper frame member and the lower frame member, the support member preferably comprises multiple recesses disposed in its top surface and multiple keys disposed on its bottom surface, the upper receiving member comprises multiple keys that communicate with the recesses in the top surface of the support member, and the lower receiving member comprises multiple recesses that communicate with the keys on the bottom surface of the support member.

In another embodiment, each movable support can comprise a plurality of support members, as depicted in FIGS. 5A and 5B. Turning to FIG. 5A, the movable support comprises a first support member 502, a second support member 512, an upper receiving member 522, and a lower receiving member 526. The first support member 502 has a top surface 504, a key 506 disposed on the top surface 504 thereof, a bottom surface 508, and a recess 510 disposed on the bottom surface 508 thereof. The second support member 512 has a top surface 514, a key 516 disposed on the top surface 514 thereof, a bottom surface 518, and a recess 520 disposed on the bottom surface 518 thereof. The key 516 disposed on the top surface 514 of the second support member 512 communicates with the recess 510 disposed in the bottom surface 508 of the first support member 502. The upper receiving member 522 is fixedly attached to the upper frame member 126 at the bottom 122 of the upper frame 104. The upper receiving member 522 comprises at least one recess 524 that communicates with the key 506 disposed on the top surface 504 of the first support member 502. The lower receiving member 526 is fixedly attached to the lower frame member 118 at the top 112 of the lower frame 102. The lower receiving member 526 comprises at least one key 528 that communicates with the recess 520 disposed in the bottom surface 518 of the second support member 512. In order to further stabilize the support members from lateral or rotational movement relative to the upper frame member and the lower frame member, the support members preferably comprise multiple keys disposed on their top surfaces and multiple recesses disposed on their bottom surfaces, the upper receiving member comprises multiple recesses that communicate with the keys on the top surface of the first support member, and the lower receiving member comprises multiple keys that communicate with the recesses in the bottom surface of the second support member.

FIG. 5B shows an alternative embodiment of a movable support which comprises a plurality of support members. The movable support comprises a first support member 552, a second support member 562, an upper receiving member 572, and a lower receiving member 576. The first support member 552 has a top surface 554, a recess 556 disposed in the top surface 554 thereof, a bottom surface 558, and a key 560 disposed on the bottom surface 558 thereof. The second support member 562 has a top surface 564, a recess 566 disposed in the top surface 564 thereof, a bottom surface 568, and a key 570 disposed on the bottom surface 568 thereof. The key 560 disposed on the bottom surface 558 of the first support member 552 communicates with the recess 566 disposed in the top surface 564 of the second support member 562. The upper receiving member 572 is fixedly attached to the upper frame member 126 at the bottom 122 of the upper frame 104. The upper receiving member 572 comprises at least one key 574 that communicates with the recess 556 disposed in the top surface 554 of the first support member 552. The lower receiving member 576 is fixedly attached to the lower frame member 118 at the top 112 of the lower frame 102. The lower receiving member 576 comprises at least one recess 578 that communicates with the key 570 disposed on the bottom surface 568 of the second support member 562. In order to further stabilize the support members from lateral or rotational movement relative to the upper frame member and the lower frame member, the support members preferably comprise multiple recesses disposed in their top surfaces and multiple keys disposed on their bottom surfaces, the upper receiving member comprises multiple keys that communicate with the recesses in the top surface of the first support member, and the lower receiving member comprises multiple recesses that communicate with the keys on the bottom surface of the second support member.

While the movable supports depicted in FIGS. 5A and 5B are shown with only two support members, the movable supports can comprise any suitable number of support members necessary to achieve the desired range of heights for the foundation. Thus, the movable support can comprise three or more support members. Furthermore, while the movable supports depicted in FIGS. 5A and 5B are shown with support members having the same arrangement of recesses and keys, the support members need not have the same arrangement of these features. For example, in an alternative embodiment of the movable support depicted in FIG. 5A, the first support member can comprise keys on both its top surface and its bottom surface, and the second support member can comprise recesses in both its top surface and its bottom surface. Further, in an alternative embodiment of the movable support depicted in FIG. 5B, the first support member can comprise recesses in both its top surface and its bottom surface, and the second support member can comprise keys on both its top surface and its bottom surface.

Figure 6:
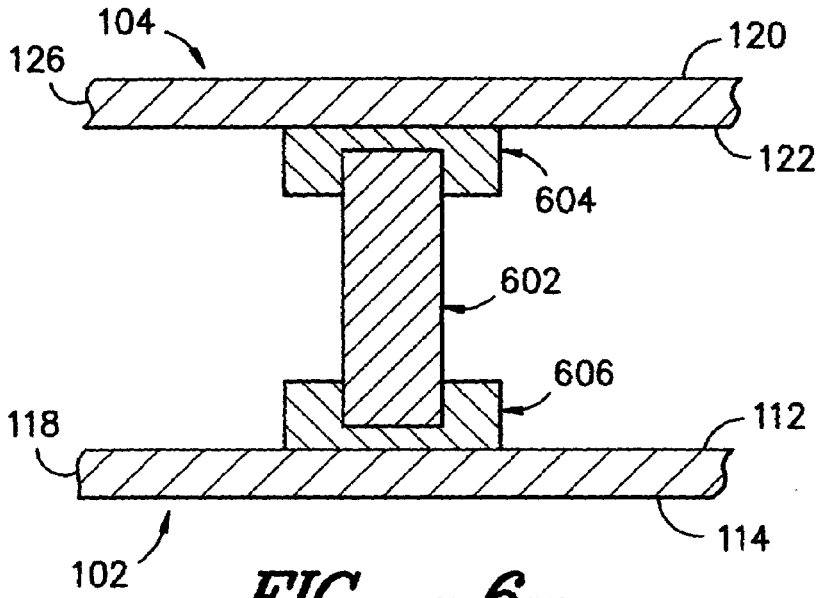
FIG. 6 is a sectional view of a movable support suitable for use in the foundation of the invention.

FIG. 6 shows an alternative embodiment of a movable support suitable for use in the foundation of the invention. As shown, the movable support comprises a support member 602, an upper receiving member 604, and a lower receiving member 606. The upper receiving member 604 is fixedly attached to the upper frame member 126 at the bottom 122 of the upper frame 104. The lower receiving member 606 is fixedly attached to the lower frame member 118 at the top 112 of the lower frame 102. The upper receiving member 604 and the lower receiving member 606 each comprise a recess on the surface thereof, the recesses are sized so that they communicate with the support member 602 and restrict lateral movement of the support member 602 relative to the upper frame 104 and the lower frame 102. In such an embodiment, the support member 602 can have an unequal length, width, and height, and the recesses in the upper receiving member 604 and the lower receiving member 606 can be sized so that any of the three different sized faces of the support member 602 can fit into the recesses. With the support member 602 and the upper and lower receiving members 604, 606 so configured, the distance between the upper frame 104 and the lower frame 102 (and the overall height of the foundation) can be adjusted between one of three predetermined dimensions based on the orientation of the support member 602. Alternatively, the foundation can be supplied with a plurality of support members, each of which has a different height and is sized so that it can communicate with the recesses provided in the upper receiving member and the lower receiving member. In such an embodiment, the distance between the upper frame and the lower frame (and the overall height of the foundation) can be varied depending upon the height of the particular support member that is used.

Figure 7A:
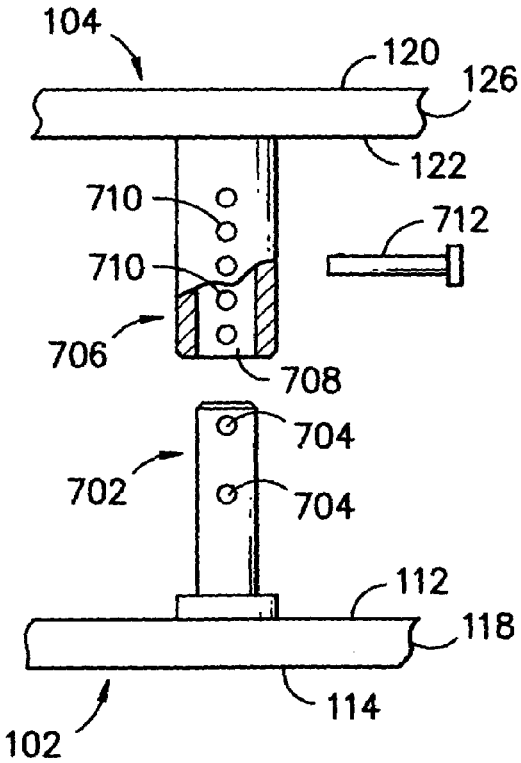
FIG. 7A is an exploded, elevation view of a movable support suitable for use in the foundation of the invention.
Figure 7B:
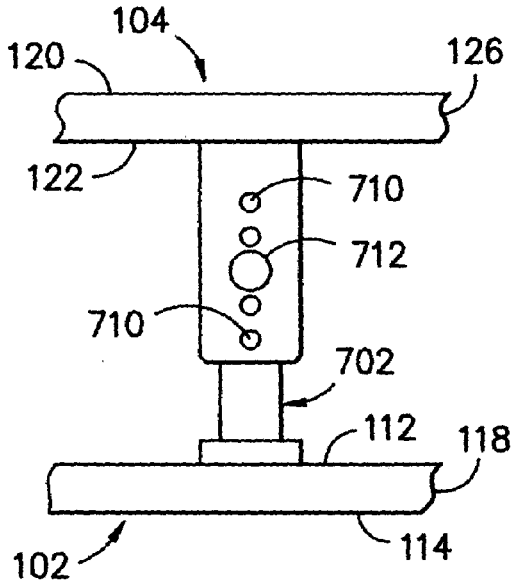
FIG. 7B is an elevation view of the movable support depicted in FIG. 7A.

FIGS. 7A and 7B show another embodiment of a movable support suitable for use in the foundation of the invention. In this embodiment, the movable support comprises a post 702, a sleeve 706 adapted to receive the post, and a pin 712. The post 702 has a proximal end, a distal end, and at least one hole 704 through the distal end thereof. The sleeve 706 has a cavity 708 in the distal end thereof, the cavity 708 being of sufficient size to permit the post 702 to pass into the interior of the sleeve 706. The sleeve 706 further comprises a plurality of aligned holes 710 disposed along its length. The pin 712 is adapted to pass through at least one of the holes 710 in the sleeve 706 and the hole 704 in the post 702 when the post 702 is disposed within the cavity 708 provided in the distal end of the sleeve 706.

FIG. 8 shows an alternative embodiment of a movable support suitable for use in the foundation of the invention. In this embodiment, the movable support comprises a support member 802 comprising an arm 804 and a receiving member 808 adapted to receive a pin 806 attached to the distal end of the arm 804. In particular, the arm 804 is pivotally attached, at its proximal end, to the lower frame member 118 at the top 112 of the lower frame 102. The receiving member 808 is attached to the upper frame member 126 at the bottom 122 of the upper frame 104 and comprises a plurality of recesses 810 disposed along its length. The recesses 810 in the receiving member 808 are adapted to receive the pin 806 attached to the distal end of the arm 804. As the arm 104 is pivoted, the pin 806 on the distal end of the arm 108 can be set into a different recess 810 disposed along the length of the receiving member 808. Thus, as the arm 804 is so pivoted, the distance between the upper frame 104 and the lower frame 102 can be varied. While this particular embodiment of the movable support is shown with the arm pivotally attached to the lower frame member and the receiving member attached to the upper frame member, the arm can be pivotally attached to the upper frame member and the receiving member can be attached to the lower frame member.

FIG. 9 depicts another embodiment of a movable support suitable for use in the foundation of the invention. In this embodiment, the support member comprises a substantially circular post 902 having a helical thread 904 disposed around its circumference. The receiving member comprises a sleeve 906 adapted to receive the post 902. The sleeve comprises a helical thread 908 disposed around the circumference of its inner surface. In this embodiment, one of the sleeve 906 or post 902 is rotatably mounted to a frame member. For example, the sleeve 906 can be rotatably mounted to the upper frame member 126 at the bottom 122 of the upper frame 104, and the post 902 can be fixedly attached to the lower frame member 118 at the top 112 of the lower frame 102. Thus, as the sleeve 906 is rotated, the distance between the upper frame 104 and the lower frame 102 can be adjusted. While this particular embodiment of the movable support is shown with the sleeve attached to the upper frame member and the post attached to the lower frame member, the sleeve can be attached to the lower frame member and the post can be attached to the upper frame member.

The movable supports suitable for use in the foundation of the invention, including those depicted in FIGS. 1-9, can be made from any suitable material. For example, the movable supports can be made from wood, metal, plastic, foam, or combinations thereof. While the support members and receiving members depicted in FIGS. 3-5B are shown with keys made from materials that are different from the rest of the support member or receiving member, the keys can be made from the same materials as the rest of the support member or receiving member. For example, the support members or receiving members, including any keys disposed thereon, can be machined from the same piece of wood, metal, plastic, or foam.

Figure 10:
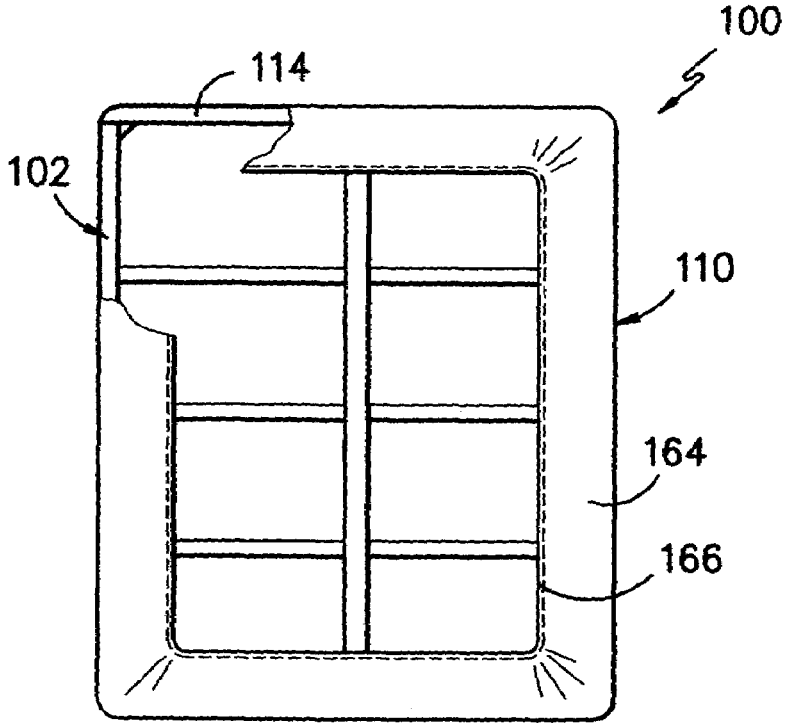
FIG. 10 is a plan, partial cut-away view of the bottom of the foundation depicted in FIG. 1.

In certain embodiments, as shown in FIGS. 1 and 2, the foundation 100 can comprise a cover 110 that masks the upper frame 104, the lower frame 102, and movable supports 106, 107 from view. In particular, the cover 110 has a top portion 160 and a side portion 162. As shown in FIG. 1, the cover 110, more specifically the top portion of the cover, rests on the top of the upper frame 104. When the cover 110 rests on the top 120 of the upper frame 104, the side portion 162 of the cover 110 extends around at least a portion of the perimeter of the upper frame 104, thereby masking the frames 102, 104 and support members 106, 107 of the foundation 100 from view. As shown in FIG. 10, the cover 110 can further comprise a bottom portion 164 having a perimeter and a resilient material 166 (e.g., an elastic band) attached to the perimeter of the bottom portion 164 of the cover 110. In such an embodiment, the side portion (not shown) of the cover 110 extends around at least a portion of the perimeter of the lower frame 102 and the bottom portion 164 of the cover 110 contacts the bottom 114 of the lower frame 102. The cover can be made from any suitable material. For example, the cover can be a textile material, such as a knit, woven, or non-woven textile. The cover can be provided in any suitable configuration that is capable of covering the top of the upper frame and masking the frames and movable supports of the foundation from view. For example, the cover can be provided in a configuration similar to that of a fitted sheet typically used to cover a mattress. Such an embodiment of the cover is depicted in FIG. 10. In an alternative embodiment of the cover depicted in FIG. 10, the resilient material can be replaced with a drawstring that gathers the excess portions of the cover as it is pulled.

In order to support a load resting on the foundation, the foundation 100 can, as shown in FIGS. 1 and 2, further comprise a resilient support 108 that is attached via suitable means to the top 120 of the upper frame 104. The resilient support can comprise any suitable material(s) that is capable of carrying a load applied to the foundation without permanent deformation or failure. For example, the resilient support can comprise a textile, such as a woven or knit textile comprising elastomeric yarns. Alternatively, the resilient support can be comprised of a plurality of metallic wires or rods which are disposed in a substantially parallel relation. In such an embodiment, the wires or rods pass from one side of the upper frame to an opposing side of the upper frame. The wires or rods can be provided with a substantially sinusoidal shape along a portion or substantially all of their length. In order to provide further rigidity and resistance to deformation, adjacent wires or rods can be connected using springs or other suitable connection means so that a load applied to the one of the wires or rods is, at least partially, distributed to the adjacent wires or rods.

The foundation of the invention can be used to support any suitable mattress. For example, the foundation of the invention can be used to support an innerspring mattress, a foam mattress, or an air mattress.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A foundation for a mattress, the foundation comprising:

(a) a lower frame having a top, a bottom, a perimeter, and one or more lower frame members disposed around at least a portion of the perimeter of the lower frame, (b) an upper frame having a top, a bottom, a perimeter, and one or more upper frame members disposed around at least a portion of the perimeter of the upper frame, and (c) a plurality of movable supports attached to one or more of the lower frame member and the upper frame member, the movable supports being adapted to maintain the upper frame and the lower frame in a spaced apart relation and being further adapted to permit vertical movement of the upper frame into a plurality of spaced apart relations relative to the lower frame, wherein (i) the movable supports comprise a support member and a receiving member, (ii) the support member is substantially rectangular in shape and has a length, a width, and a height, and the length, width, and height of the support member are unequal, wherein the spaced apart relation of the upper frame and lower frame can be adjusted between one of three predetermined heights based on the orientation of the support member within the foundation, and (iii) the receiving member is attached to one of the lower frame member and the upper frame member and is adapted to receive the support member and restrict lateral movement of the support member relative to the upper frame and the lower frame, and wherein each surface of the support member comprises a plurality of keys or recesses.

* * * * *